US007557796B2

(12) United States Patent
Voto et al.

(10) Patent No.: US 7,557,796 B2
(45) Date of Patent: Jul. 7, 2009

(54) JOYSTICK SENSOR WITH TWO-DIMENSIONAL IMAGE SENSING

(75) Inventors: Andrew M. Voto, Brighton, MI (US); Ronald K. Selby, Flint, MI (US); Kenneth D. Perry, New Lothrop, MI (US); David A. Ross, Columbiaville, MI (US); Alfred V. Dumsa, Jr., Hartland, MI (US)

(73) Assignee: Delphi Technologies, Inc., Troy, MI (US)

( * ) Notice: Subject to any disclaimer, the term of this patent is extended or adjusted under 35 U.S.C. 154(b) by 591 days.

(21) Appl. No.: 11/178,549

(22) Filed: Jul. 11, 2005

(65) Prior Publication Data

US 2006/0146021 A1 Jul. 6, 2006

Related U.S. Application Data

(60) Provisional application No. 60/638,742, filed on Dec. 22, 2004.

(51) Int. Cl.
*G09G 5/08* (2006.01)

(52) U.S. Cl. ..... 345/161; 345/156

(58) Field of Classification Search ..... 345/156–168, 345/184; 74/485; 434/45; 463/30
See application file for complete search history.

(56) References Cited

U.S. PATENT DOCUMENTS

| | | | | |
|---|---|---|---|---|
| 6,181,327 | B1 * | 1/2001 | Lin et al. | 345/161 |
| 6,300,940 | B1 * | 10/2001 | Ebina et al. | 345/161 |
| 6,639,581 | B1 * | 10/2003 | Moore et al. | 345/156 |
| 6,760,006 | B2 * | 7/2004 | Arita et al. | 345/156 |
| 2002/0000971 | A1 * | 1/2002 | Armstrong | 345/156 |

* cited by examiner

*Primary Examiner*—Richard Hjerpe
*Assistant Examiner*—Mansour M Said
(74) *Attorney, Agent, or Firm*—Thomas N. Twomey

(57) ABSTRACT

A manually-operated control for generating a vector signal comprises a handle with an elongate axis pivotally mounted to the housing for universal rotation about a pivot point on the axis of the handle. An imaged surface moves in two directions with the rotation of the handle about two perpendicular axes intersecting at the pivot point. A camera and LED are focused on the imaged surface. A microprocessor-based controller inputs and processes images sequentially input from the camera for detecting and quantifying the movement of the imaged surface in two directions and generates a vector signal indicative thereof.

17 Claims, 2 Drawing Sheets

JOYSTICK SENSOR WITH TWO-DIMENSIONAL IMAGE SENSING

CROSS-REFERENCE TO RELATED APPLICATION

This application claims the benefit of U.S. Provisional Application Ser. No. 60/638,742, filed Dec. 22, 2004, which is herein incorporated by reference in its entirety.

BACKGROUND OF THE INVENTION

1. Field of the Invention

This invention relates to manual controls of the joystick type useful in the operation of motorized wheelchairs. The manual controls have numerous other applications, such as in the operation of video games.

2. Description of Related Art

There is a need for inexpensive yet accurate manual controls for providing direction and speed signals for motorized wheelchairs. Controls of this type are often referred to as joystick controls. Typically, they are provided with a handle that is pivotally mounted for universal rotation about a point along its axis. Sensors are provided for sensing the angle of tilt along the perpendicular axes through the point of rotation. Numerous sensing schemes have been used, such as potentiometers in contact with brushes that move corresponding to the tilt of the joystick. See U.S. Pat. Nos. 4,856,785 and 6,259,433. Another sensing scheme involves the interaction of induction coils. See U.S. Pat. Nos. 4,879,556 and 5,911,627. Hall effect and other magnetic sensors have been used for sensing the tilt. See U.S. Pat. Nos. 5,160,918; 5,831,554; and 5,831,596.

Recently, the development of miniaturized cameras has been applied to the detection of the movement of computer mouse controls over a surface. See U.S. Pat. Nos. 6,172,354 and 6,664,948 incorporated herein by reference. However, this technology has not yet been successfully applied to joystick-type controls and, in particular, controls for battery-operated joystick-controlled wheelchairs. Computer mouse controls simply need to command relative movement of the mouse pointer on the computer monitor display and do not need to provide absolute displacement from a home position.

SUMMARY OF THE INVENTION

It is an advantage, according to the present invention, to provide a manual control comprising a joystick control with a minimum number of parts. The unique application of two-dimensional array image sensor technology, such as CCD sensors and CMOS sensors, to joystick sensing enables a far less complicated assembly with far fewer parts than prior art joystick controls.

Briefly, according to the present invention, there is provided a manually-operated control for generating a vector signal comprising a housing defining a socket for a universal joint. A handle with an elongate axis is pivotally mounted within the socket of the housing for universal rotation about a pivot point on the axis of the handle. The housing has a structure supporting an imaged surface that moves in two directions with the rotation of the handle about two perpendicular axes intersecting at the pivot point. A single circuit board is fixed to the interior of the housing for supporting an array image sensor camera and LED focused on the imaged surface. A microprocessor-based controller is mounted on the circuit board and is connected to input and process images sequentially input from the camera for detecting and quantifying the movement of the image surface in two directions and for generating a vector signal indicative of the movement. Most preferably, universal rotation of the handle is provided by a ball and socket connection, the ball being connected with the handle and the socket being formed at least partially in the housing. Most preferably, the control comprises a biasing spring or structure between the housing and the handle for urging the handle to return to a home position relative to the housing. The housing can be made from a minimum of injection molded shapes that snap together over the handle and circuit board.

The vector signal may comprise two signals each representative of a displacement from a home position taken along perpendicular directions. Alternately, the vector signal may comprise a signal indicative of the angular direction of the displacement and a signal indicative of the direct displacement from home.

According to one preferred embodiment of the present invention, the housing comprises a cover and a base. The cover has an opening therein for the handle to pass through. The base has the lower half of a spherical socket formed therein. A slider support structure is fixed between the base and the cover and has formed therein the upper half of a spherical socket. A ball connected to the handle is captured in the socket. The slider support surface captures a slider plate below the cover and is connected by an opening to the handle between the pivot point and the distal end of the handle. The slider plate serves as the imaged surface.

According to another preferred embodiment, the housing is comprised of a cover and a base. The cover has an opening therein for the handle to pass through and the upper half of a spherical socket is formed therein. A ball connected to the handle is captured in the socket. The base has the lower half of a spherical socket formed therein. There is an opening in the lower half of the spherical socket aligned with the opening in the cover. The structure supporting the imaged surface is the portion of the ball exposed through the opening in the lower half of the spherical socket.

BRIEF DESCRIPTION OF THE DRAWINGS

Further features and other objects and advantages will become apparent from the following detailed description made with reference to the drawings in which.

DESCRIPTION OF THE PREFERRED EMBODIMENTS

Figure 1:
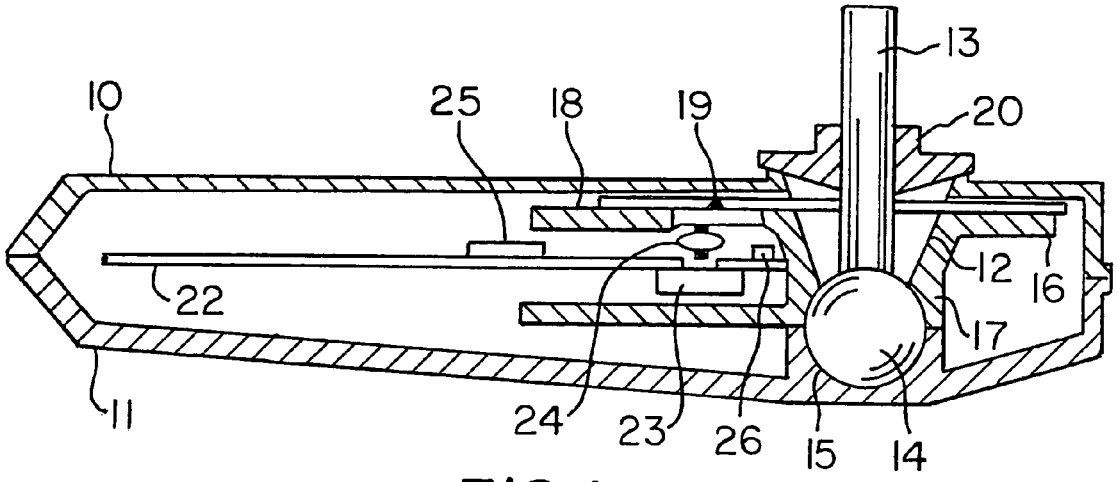
FIG. 1 is a section of a joystick controller according to one embodiment of the present invention.

Referring to FIG. 1, there is shown a housing comprised of an upper housing or cover 10 and a lower housing or base 11 that may be joined together by a snap connection or held together by fasteners. The design of injection molded parts that snap together or secured together with a minimum of threaded fasteners is common. The cover 10 has an opening through which a handle 13 passes. The handle terminates in a ball 14, the center of which is on the axis of the handle. In the base 11 is formed the lower half of spherical socket 15 for receiving in sliding contact therewith a load-bearing surface (here shown as ball 14). A slider support structure 16 is fixed between the cover and base. The slider support structure has formed therein the upper half 17 of the spherical socket.

Opening upwardly from the spherical socket in the slider plate support structure is a conical recess 12 for limiting the motion of the handle as the handle is rotated about one or both perpendicular axes which are perpendicular to the axis of the handle. The slider plate support structure has a planar surface 18 that is adjacent to a planar surface on the underside of the cover. A slider plate 19 is captured in the space between the planar surface 18 and the underside of cover 10. The slider plate has an opening slightly larger than the outer dimensions of the handle 13 so that as the handle 13 is moved about within the confines of the conical recess, the slider plate can slide freely in two directions as urged by the handle 13 without binding and with a minimum of lost motion. A resilient skirt 20 surrounds the handle and bears on the housing biasing the handle to an upright home position.

Mounted in the housing is a printed circuit board 22 having a camera 23 (a two-dimensional array image sensor), lens 24, and microprocessor 25. An LED 26 is also mounted on the circuit board. The camera 23 and LED 26 are focused on the imaged surface of the slider plate 19. The camera 23 generates signals for each pixel in the array. The output of the camera is a frame of pixel signals defining an image. The digitized output of the camera is input to a microprocessor-based controller 25 mounted on the circuit board. By comparison of sequentially input images, the microprocessor-based controller 25 can determine the movement of the slider plate in two dimensions as the handle moves away from the home position. Apparatus and methods for detecting movement are disclosed, for example, in U.S. Pat. Nos. 6,172,354 and 6,664,948 incorporated herein by reference. While no pattern is required on the imaged surface of the slider plate to determine the movement of the slider plate, a home marker of some type is preferably provided on the imaged surface aligned with the camera when the handle is at the home position.

Figure 3:
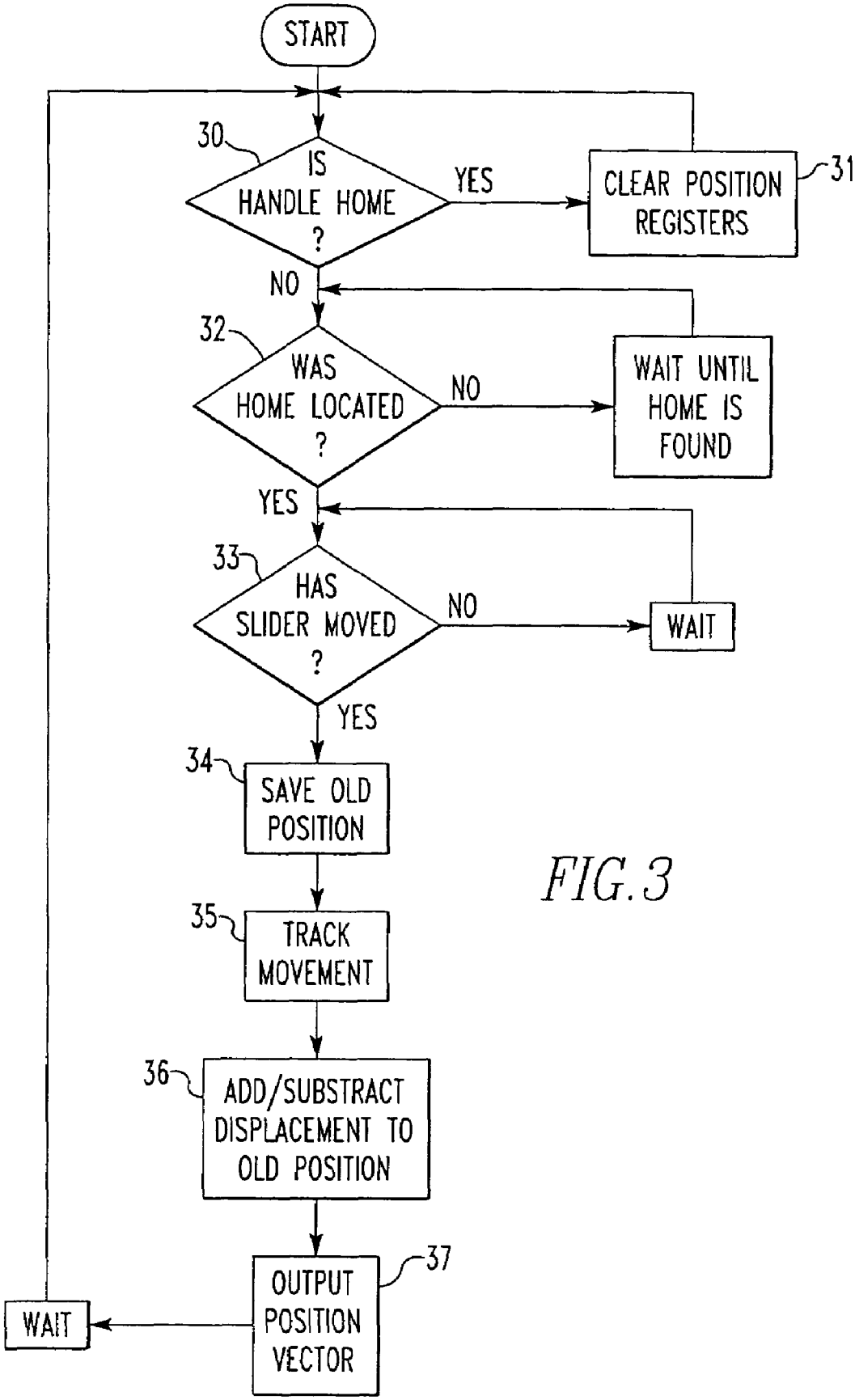
FIG. 3 is a schematic diagram of a computer method for detecting displacement, according to the present invention.

A computer method of detecting the displacement of the handle is shown in the FIG. 3. At step 30, the image input from the camera is compared to the home image to determine if the handle is at the home position. If so, position registers are cleared at step 31. If the home position was not previously detected, at step 32 nothing is done until it is detected and the position registers are then cleared. If the home position was earlier found, then a test is made to determine if the slider has moved at step 33. If it has not, the old position values remain in the position registers and the program awaits movement of the slider plate. If the slider plate has moved, the old position is saved at step 34 and the extent of the displacement is detected at step 35 and added to the position registers at step 36. The values in the position register are continually output at step 37, for example, to a control system for the battery-powered wheelchair. After a short wait, the process is repeated.

Figure 2:
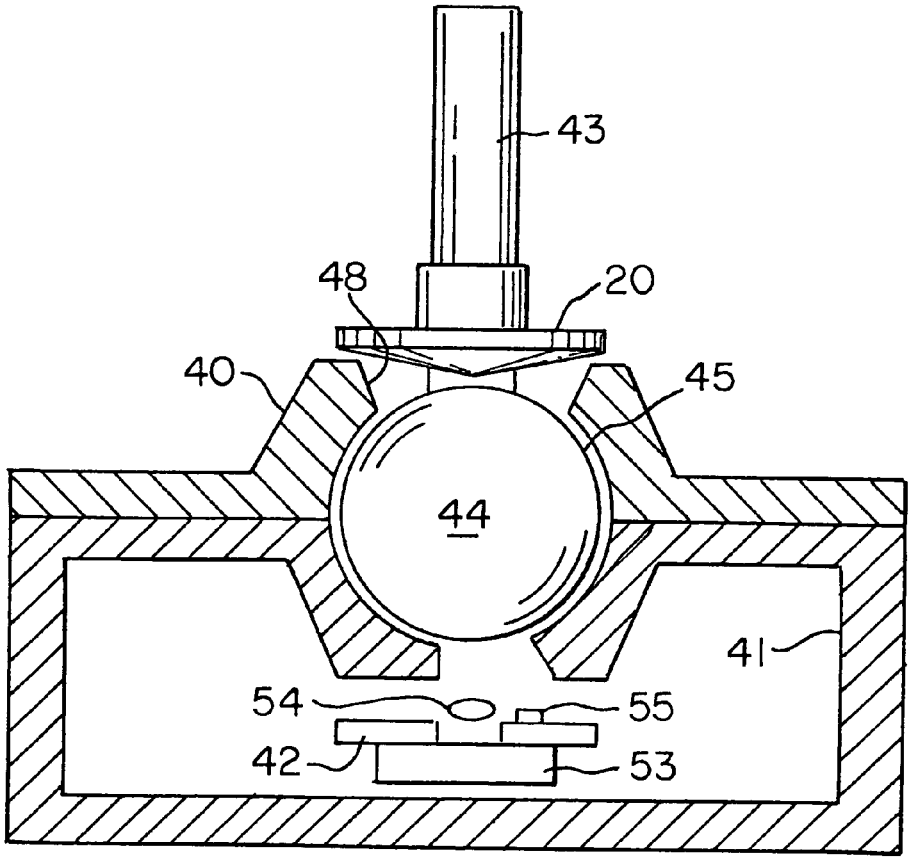
FIG. 2 is a partial section of a joystick controller according to another embodiment of the present invention.

Referring to FIG. 2, there is shown an alternate embodiment housing comprised of an upper housing or cover 40 and a lower housing or base 41 that may be joined together by a snap connection or held together by fasteners. The cover 40 has an opening through which a handle 43 passes. The cover has formed therein the upper half of a spherical socket 45 and a conical recess 48 opening from the socket. The handle 43 terminates in a load-bearing surface, for example, a ball 44, the center of which is on the axis of the handle. In the base 41 is formed the lower half of the spherical socket 45 for receiving the ball 44 for sliding contact. The conical recess 48 limits the motion of the handle as the handle is rotated about one or both perpendicular axes perpendicular to the axis of the handle and defined by the ball and socket. Resilient skirt 20 acts to return the handle to an upright or home position. There is an opening in the lower half of the socket aligned with the opening in the cover 40.

Mounted in the base of the housing is a printed circuit board 42 having a camera 53, a two-dimensional array detector, and a lens 54. The lens 54 projects an image on the camera 53. An LED 55 is also mounted on the circuit board 42. The camera 53 and LED 55 are focused on the surface of the ball exposed through the opening in the lower half of the socket. The detection of the motion of the ball due to rotation of the handle is the same as described above for the detection of the motion of the slider plate.

Having thus described our invention with the detail and particularity required by the Patent Laws, what is desire protected by Letters Patent is set forth in the following claims.

The invention claimed is:

1. A manually-operated control for generating a vector signal comprising: a housing; a handle with an elongate axis pivotally mounted to the housing for universal rotation about a pivot point on the axis of the handle, wherein the universal rotation of the handle is provided by a ball and socket connection, the ball being connected with the handle and the socket being formed at least partially in the housing; a structure supporting an imaged surface that moves in two directions with the rotation of the handle about two perpendicular axes intersecting at the pivot point; a circuit board fixed to the interior of the housing; a camera and LED fixed to the circuit board and focused on the imaged surface; and a microprocessor-based controller mounted on the circuit board and connected to input and process images sequentially input from said camera for detecting and quantifying the movement of the imaged surface in two directions and generating a vector signal indicative thereof, wherein the housing is comprised of a cover with an opening therein for the handle to pass through, a base having the lower half of a spherical socket therein, and a slider support structure that is located between the base and the cover and having the upper half of a spherical socket therein and a slider support surface thereon.

2. A manually-operated control according to claim 1, wherein the structure supporting the imaged surface is a plate slidably mounted in the housing and connected by a guide opening to the handle between the pivot point and the distal end of the handle.

3. The manually-operated control according to claim 2, further comprising a lens tat is positioned to project the imaged surface towards the camera.

4. The manually-operated control according to claim 3, wherein the movement of the plate in the two directions is in a plane substantially parallel to the camera.

5. The manually-operated control according to claim 2, wherein the imaged surface further comprises a home marker, the home marker being aligned with the camera when the handle is at a home position.

6. The manually-operated control according to claim 1, wherein the vector signal is comprised of two displacement from home signals.

7. The manually-operated control according to claim 1, wherein the vector signal is comprised of an angular direction signal and a displacement from home signal.

8. The manually-operated control according to claim 1, further comprising biasing means between the housing and the handle for urging the handle to return to a home position relative to the housing.

9. The manually-operated control according to claim 1, further comprising a lens that is positioned to project the imaged surface towards the camera.

10. The manually-operated control according to claim 1 wherein the camera is a two-dimensional array image sensor.

11. A manually-operated control for generating a vector signal comprising: a housing; a handle with an elongate axis pivotally mounted to the housing for universal rotation about a pivot point on the axis of the handle, wherein the universal rotation of the handle is provided by a ball and socket connection, the ball being connected with the handle and the socket being formed at least partially in the housing; a structure supporting an imaged surface that moves in two directions with the rotation of the handle about two perpendicular axes intersecting at the pivot point; a circuit board fixed to the interior of the housing; a camera and LED fixed to the circuit board and focused on the imaged surface; and a microprocessor-based controller mounted on the circuit board and connected to input and process images sequentially input from said camera for detecting and quantifying the movement of the imaged surface in two directions and generating a vector signal indicative thereof, wherein the housing is comprised of a cover and a base, said cover having an opening therein for the handle to pass through and the upper half of a spherical socket formed therein connected to the opening for the handle, said base having the lower half of a spherical socket formed therein, there being an opening in the lower half of the spherical socket aligned with the opening in the cover, the structure supporting the imaged surface being the portion of the ball exposed through the opening in the lower half of the spherical socket.

12. The manually-operated control according to claim 11, further comprising a lens that is positioned to project the imaged surface towards the camera

13. The manually-operated control according to claim 11, wherein the imaged surface further comprises a home marker, the home marker being aligned with the camera when the handle is at a home position.

14. The manually-operated control according to claim 11, wherein the vector signal is comprised of two displacement from home signals.

15. The manually-operated control according to claim 11, wherein the vector signal is comprised of an angular direction signal and a displacement from home signal.

16. The manually-operated control according to claim 11, further comprising biasing means between the housing and the handle for urging the handle to return to a home position relative to the housing.

17. The manually-operated control according to claim 11, wherein the camera is a two-dimensional array image sensor.

* * * * *